US006513274B1

(12) United States Patent
Vastag

(10) Patent No.: US 6,513,274 B1
(45) Date of Patent: Feb. 4, 2003

(54) REMOVABLE SYSTEM FOR CONVERTING A BREACH LOADING SHOTGUN TO A .22 LONG RIFLE

(76) Inventor: Laszlo Vastag, R.R. 1, Box 135A, Stamford, NY (US) 12167

( * ) Notice: Subject to any disclaimer, the term of this patent is extended or adjusted under 35 U.S.C. 154(b) by 0 days.

(21) Appl. No.: 09/911,091

(22) Filed: Jul. 23, 2001

(51) Int. Cl.[7] ..... F41A 21/10
(52) U.S. Cl. ..... 42/77; 42/135; 42/139
(58) Field of Search ..... 42/77, 135, 139

(56) References Cited

U.S. PATENT DOCUMENTS

| | | | | | |
|---|---|---|---|---|---|
| 72,063 | A | * | 12/1867 | McCulloch | |
| 1,179,021 | A | * | 4/1916 | Mayer | |
| 2,352,476 | A | * | 6/1944 | French | 102/41 |
| 3,696,542 | A | * | 10/1972 | Ekfeldt et al. | 42/16 |
| 3,805,434 | A | * | 4/1974 | Sudano | 42/77 |
| 3,945,142 | A | * | 3/1976 | Keppeler | 42/135 |
| 4,222,191 | A | * | 9/1980 | Lee et al. | 42/51 |
| 4,404,765 | A | * | 9/1983 | Reudelsterz et al. | 102/446 |
| 4,494,332 | A | * | 1/1985 | Matievich | 42/59 |
| 4,519,156 | A | * | 5/1985 | Shaw | 42/51 |
| 4,633,781 | A | * | 1/1987 | Bergman | 102/446 |
| 4,648,192 | A | * | 3/1987 | Harness | 42/75.04 |
| 4,691,442 | A | * | 9/1987 | Center | 42/135 |
| 5,018,293 | A | * | 5/1991 | Mainland | 42/46 |
| 5,208,407 | A | * | 5/1993 | Stover | 42/112 |
| 5,448,848 | A | * | 9/1995 | Moller | 42/77 |
| 5,666,756 | A | * | 9/1997 | Moller | 42/47 |
| 5,706,599 | A | * | 1/1998 | Knight | 42/124 |
| 5,987,797 | A | * | 11/1999 | Dustin | 42/75.02 |

* cited by examiner

*Primary Examiner*—Charles T. Jordan
*Assistant Examiner*—Bret Hayes

(57) ABSTRACT

A removable system for converting a breach loading shot gun with center fire cartridges for use with .22 caliber rim fire rifle cartridges has a cylindrical sleeve nut with an axial hole drilled through with a thread at its interior end and with a ball shape at the interior end. A steel tube has a .22 caliber rifling with an exterior end adapted to threadedly receive the sleeve nut, a hexagonally shaped surface on an intermediate step and a step formed on the interior end with a thread. A dummy shotgun shell has a hole through the interior end threaded halfway from the exterior end and a chamber at the exterior end adapted to receive a .22 caliber rim fired cartridge. The thread and chamber are axially aligned but offset from the centerline of the dummy shell.

4 Claims, 5 Drawing Sheets

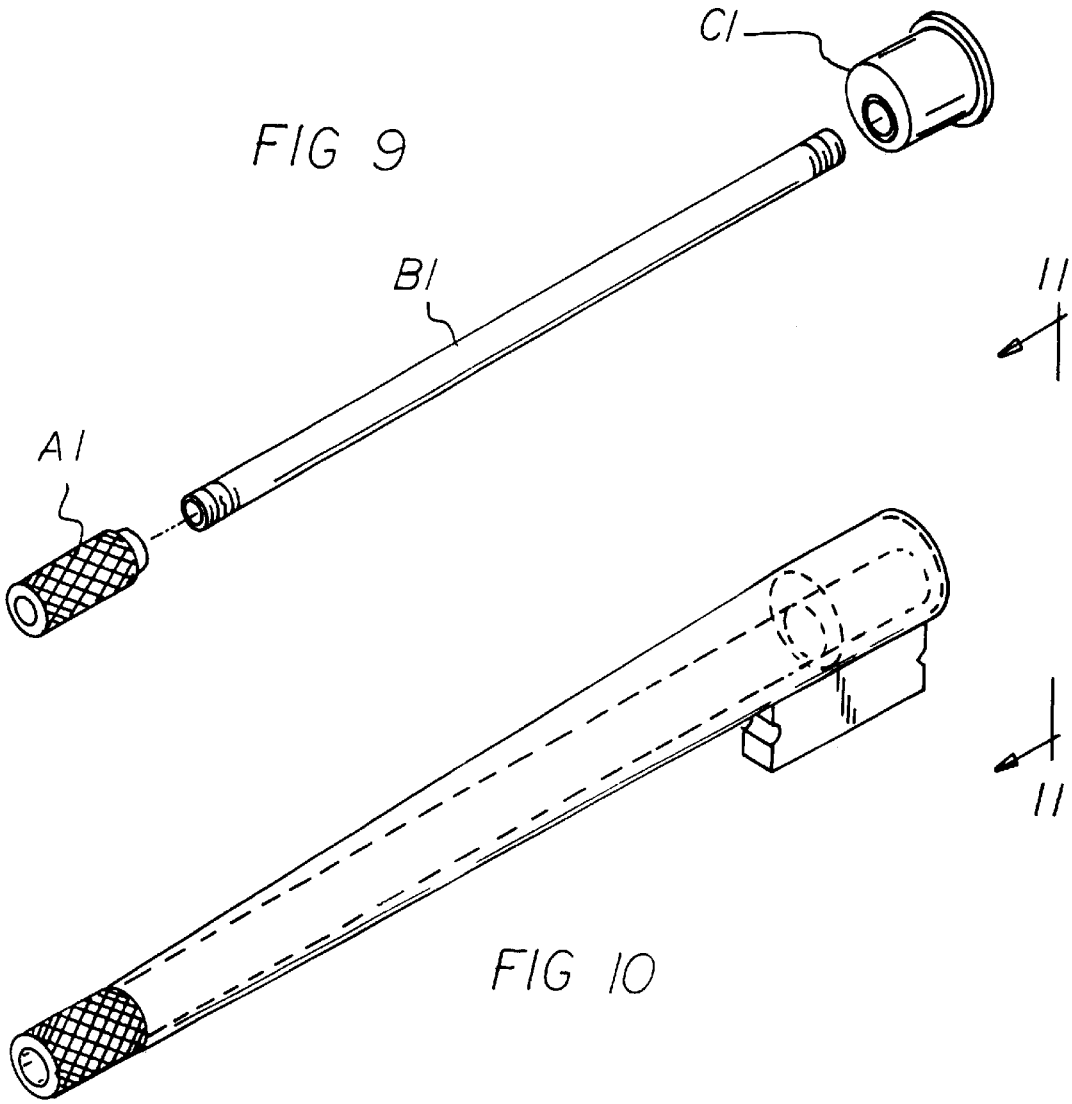
FIG 9
FIG 10
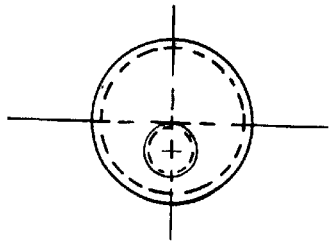
FIG 11

FIG 12
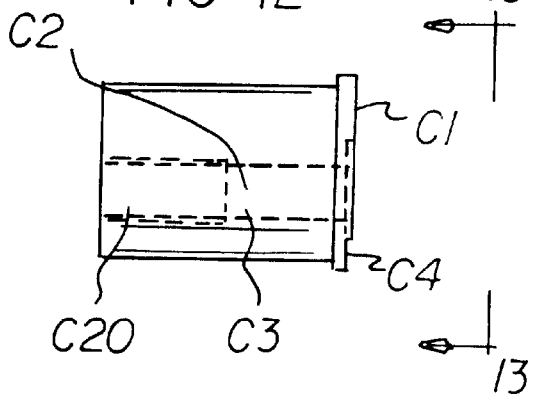
FIG 13
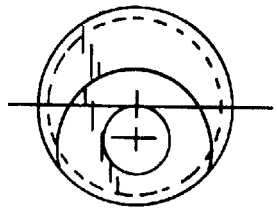
FIG 14
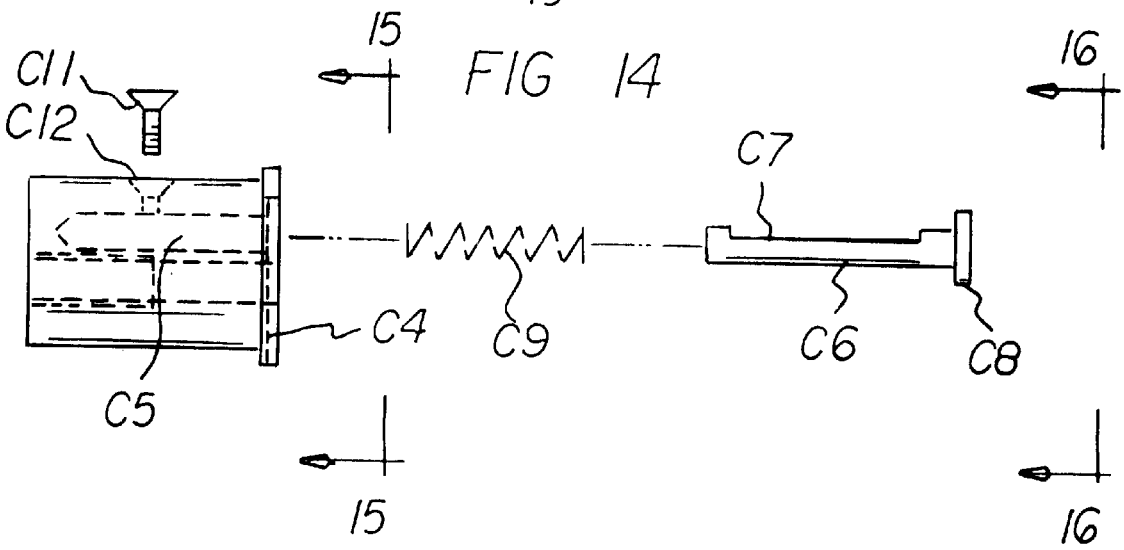
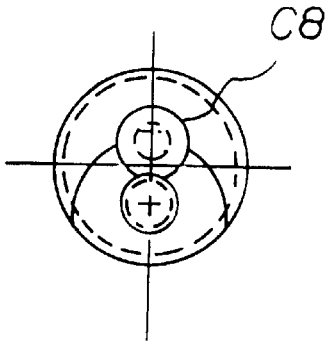
FIG 15
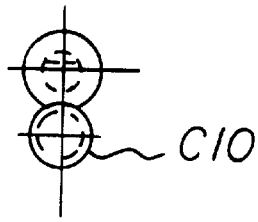
FIG 16

FIG 17
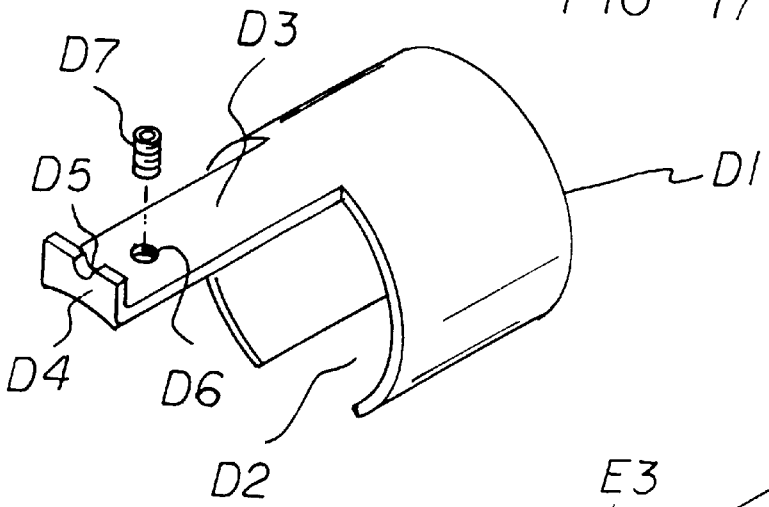
FIG 18
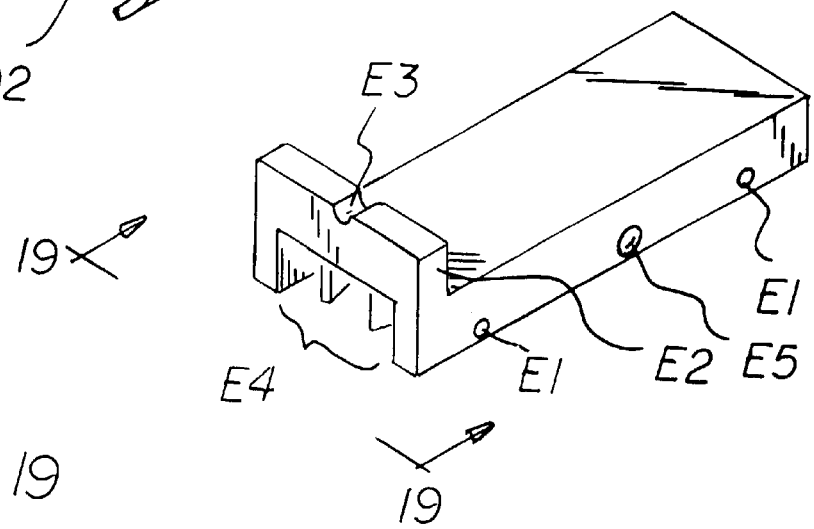
FIG 19
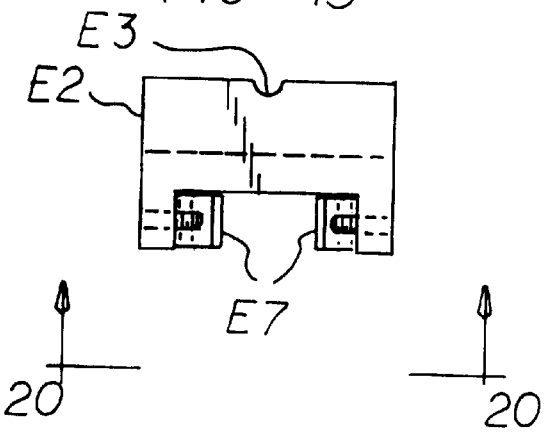
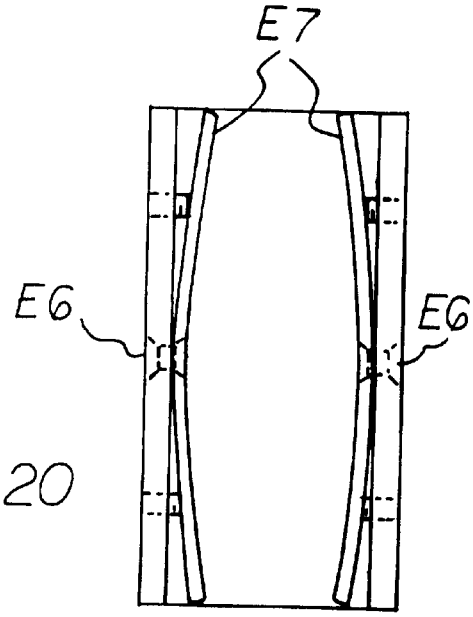
FIG 20

FIG 21
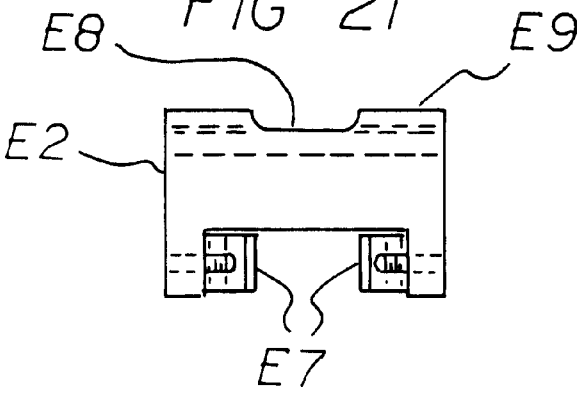
FIG 22
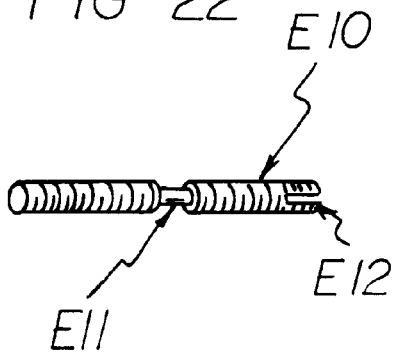
FIG 24
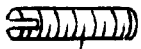
FIG 25
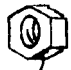
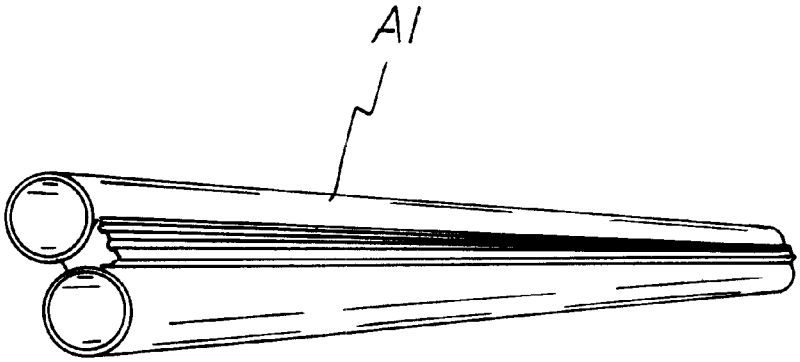
FIG 23

REMOVABLE SYSTEM FOR CONVERTING A BREACH LOADING SHOTGUN TO A .22 LONG RIFLE

BACKGROUND OF THE INVENTION

1. Field of the Invention

The present invention relates to a removable system for converting a breach loading shotgun to a .22 long rifle and more particularly pertains to allowing conventional shot guns with center fire cartridges to be used for firing rifles with rim fire cartridges.

2. Description of the Prior Art

The use of firearm converters is known in the prior art. More specifically, firearm converters previously devised and utilized for the purpose of converting firearm capabilities are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,882,997 to Baxter et al. discloses tubular projectiles. U.S. Pat. No. 4,437,249 to Brown et al. discloses conversion of modern shotguns into muzzleloading shotguns. Lastly, U.S. Pat. No. 5,755,053 to Oakley discloses a shotgun converter plug.

While these devices fulfill their respective, particular objectives and requirements, the aforementioned patents do not describe a removable system for converting a breach loading shotgun to a .22 long rifle that allows conventional shot guns with center fire cartridges to be used for firing rifles with rim fire cartridges.

In this respect, the removable system for converting a breach loading shotgun to a .22 long rifle according to the present invention substantially departs from the conventional concepts and designs of the prior art, and in doing so provides an apparatus primarily developed for the purpose of allowing conventional shot guns with center fire cartridges to be used for firing rifles with rim fire cartridges.

Therefore, it can be appreciated that there exists a continuing need for a new and improved removable system for converting a breach loading shotgun to a .22 long rifle which can be used for allowing conventional shot guns with center fire cartridges to be used for firing rifles with rim fire cartridges. In this regard, the present invention substantially fulfills this need.

SUMMARY OF THE INVENTION

In view of the foregoing disadvantages inherent in the known types of firearm converters now present in the prior art, the present invention provides an improved removable system for converting a breach loading shotgun to a .22 long rifle. As such, the general purpose of the present invention, which will be described subsequently in greater detail, is to provide a new and improved removable system for converting a breach loading shotgun to a .22 long rifle and method which has all the advantages of the prior art and none of the disadvantages.

To attain this, the present invention essentially comprises a removable system for converting a breach loading shotgun to a .22 long rifle to allow conventional shot guns with center fire cartridges be used for firing rifles with rim fire cartridges comprising a cylindrical sleeve nut with an axial hole drilled through for a thread, the nut having a knurled exterior surface with one end of the nut having a ball or alternatively an angle shape to centralize the front of the sleeve in the shotgun barrel and with the other end of the nut machined to a hexagon for allowing the nut to be able to be tightened with a tool and optionally the hexagon shape formed inside of the nut whereby an Allen wrench can be used to tighten the nut; a steel tube with a .22 caliber rifling with one end having a thread to take the sleeve nut and with the other end of the sleeve having a step, the step at one end having machined on it a hexagon shape for a tool to grab the sleeve in the event that the dummy shell is exchanged, and with the other end having a step which has a thread for the dummy shell to be screwed on; a dummy shotgun shell having a rim at one end with a hole going through which halfway is a thread and the other half is a hole chambered for a .22 caliber rim fired cartridge, the end of the chamber which is on the dummy cartridge rim is a cavity which is a clearance for the rim for the .22 caliber rim fire cartridge, the thread and the chamber are in the same axial line but off of the center line in relation with the center line of dummy cartridge, and alternately, a hole drilled parallel with the thread and the chamber almost as deep as the length of the dummy cartridge whereby the side of the nail, which has a flat portion where a flat headed screw goes at a location on the dummy cartridge to prevent the nail from coming out from its location when it is pushed by the spring so that the head of the nail pushes the cartridge out from its location when the gun is broken open, the flat area also regulating the length of the cartridge which will stick out from the sleeve chamber when the gun is open, the nail head having a cavity location in the dummy cartridge next to the cavity with a .22 cartridge rim cavity, the dummy cartridge chamber being off the center line in relation with the center line of the dummy cartridge in order for the firing pin to hit the rim of the .22 caliber rim cartridge; and a sight for a single barrel shotgun fabricated of a spring ring having an open bottom and a tail at the top of the ring having the end bent 90 degrees upward with a radius notch, the ring being tempered with a slight angle being from the front and going towards the tail, a hole on the tail in front of the bend end with a short set screw for adjusting the sight up and down, directing the bullet up or down and by rotating the hole sight on the shotgun barrel left and right, a user may adjust the sight left and right; and an optional second sight for a double barrel shotgun fit on the rib between the barrels with four small screws, the sight is fabricated of a piece of rectangular steel having on the end at the top a strap with a screw, a groove at the bottom of the sight reaching from one end to the other end forming two legs with each leg having three small holes and with two threaded holes on each leg for the fastening screws on the rib which are at the extremes of the sight legs, and with a hole between the screws and a rivet fastened to each sight leg, and a rectangular spring steel has only one hole in the middle for the rivet to fasten to the spring steel forming an arch reducing the space between the legs to accommodate the rib dimension variation and also to slightly adjust the sight left or right whereby the groove can be adjustable.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved removable system for converting a breach loading shotgun to a .22 long rifle which has all of the advantages of the prior art firearm converters and none of the disadvantages.

It is another object of the present invention to provide a new and improved removable system for converting a breach loading shotgun to a .22 long rifle which may be easily and efficiently manufactured and marketed.

It is further object of the present invention to provide a new and improved removable system for converting a breach loading shotgun to a .22 long rifle which is of durable and reliable constructions.

An even further object of the present invention is to provide a new and improved removable system for converting a breach loading shotgun to a .22 long rifle which is susceptible of a low cost of manufacture with regard to both materials and labor, and which accordingly is then susceptible of low prices of sale to the consuming public, thereby making such removable system for converting a breach loading shotgun to a .22 long rifle economically available to the buying public.

Even still another object of the present invention is to provide a removable system for converting a breach loading shotgun to a .22 long rifle for allowing conventional shot guns with center fire cartridges to be used for firing rifles with rim fire cartridges.

Lastly, it is an object of the present invention to provide a new and improved removable .22 long rifle converter system for breach loading shot guns comprising a cylindrical sleeve nut with an axial hole drilled through for a thread with one end of the nut having a ball to centralize the front of the sleeve in the shotgun barrel; a steel tube with a .22 caliber rifling with one end having a thread to take the sleeve nut and with the other end of the sleeve having a step, the step at one end having machined on it a hexagon shape and with the other end having a step which has a thread for the dummy shell to be screwed on; and a dummy shotgun shell having a rim at one end with a hole going through which halfway is a thread and the other half is a hole chambered for a .22 caliber rim fired cartridge, the end of the chamber which is on the dummy cartridge rim is a cavity which is a clearance for the rim for the .22 caliber rim fire cartridge, the thread and the chamber are in the same axial line but off of the center line in relation with the center line of dummy cartridge.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is an exploded perspective view of a sleeve, sleeve nut and a dummy shotgun shell.

FIG. 10 is a perspective view of the components of FIG. 9 shown in a shotgun barrel.

FIG. 11 is an end view taken along line 11—11 of FIG. 10.

FIG. 12 is a side elevational view of a dummy shotgun shell.

FIG. 13 is an end view taken along line 13—13 of FIG. 12.

FIG. 14 is an exploded side elevational view of the shell of FIG. 12 with associated components.

FIGS. 15 and 16 are end views taken along lines 15—15 and 16—16 of FIG. 14.

FIG. 17 is a perspective view of a sight for use with a single barrel shotgun.

FIG. 18 is a perspective view of a sight for use with a double barrel shotgun.

FIGS. 19 and 20 are elevational views taken along lines 19—19 and 20—20 of FIG. 18.

FIG. 21 is an elevation of the optional rear sight.

FIG. 22 is a perspective view of the threaded rod to be threaded in FIG. 21 in which the middle of the rod will be removed about 1/16 inch.

FIG. 23 is a perspective view of the barrels of a double barrel shotgun showing the rib between the barrels.

FIG. 24 is a perspective view of the nut of the optional rear sight of FIG. 21.

FIG. 25 is a perspective view of the set screw of the optional rear site of FIG. 21.

The same reference numerals refer to the same parts throughout the various Figures.

DESCRIPTION OF THE PREFERRED EMBODIMENT

Figure 3:
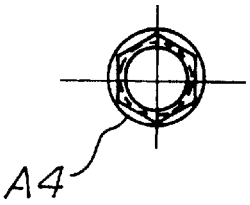
FIGS. 2 and 3 shown a optional short sleeve nut, side view and end view, with an external hexagon.
Figure 2:
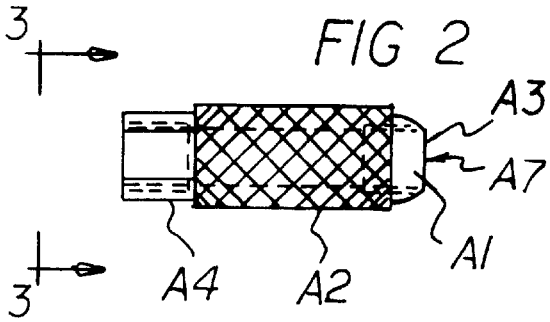
Figure 1:
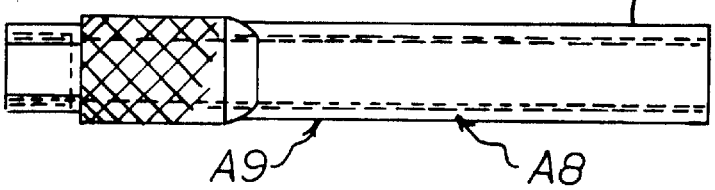
FIG. 1 is a side elevational view of an elongated sleeve nut.
Figure 5:
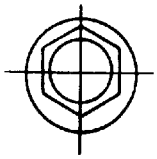
FIGS. 4 and 5 show another optional short sleeve nut, side view and end view, with an internal hexagon.
Figure 4:
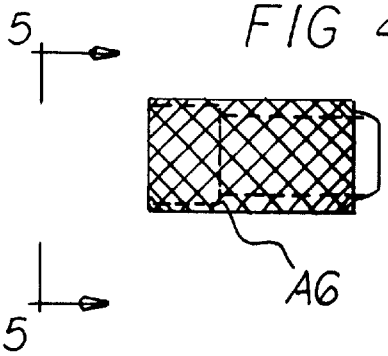

With reference now to the drawings, and in particular to FIG. 1 thereof, the preferred embodiment of the new and improved removable system for converting a breach loading shotgun to a .22 long rifle embodying the principles and concepts of the present invention and generally designated by the reference numeral 10 will be described.

The present invention, the removable system for converting a breach loading shotgun to a .22 long rifle 10 is comprised of a plurality of components. Such components in their broadest context include a sleeve nut (Part A), a steel tube or sleeve (Part B), a dummy shotgun shell (Part C), and a sight (Parts D & E). Such components are individually configured and correlated with respect to each other so as to attain the desired objective.

The present invention is a new and improved removable system for converting a breach loading shotgun to a .22 long rifle, rim fire cartridge or any other smaller caliber center fire cartridge. The basic idea is to insert a sleeve into a breach loading 20 to 10 gauge shotgun barrel in order to make possible a shotgun, one of the type which normally fires a shotgun shell center fire cartridge, and a make it possible to fire a smaller diameter rim fire cartridge. The sleeve is smaller in exterior diameter than the inside diameter of the existing shotgun barrel to be converted. Also, the sleeve will stay tilted inside the shotgun barrel. It will be tilted at an angle so that the center line of the shotgun barrel will be about 3/32 inches off center line in relation with the center line of the sleeve. As such, a .22 caliber rim fire cartridge loaded into the sleeve will have its rim at the center line of the shotgun barrel. This is needed since the hammer of the conventional shotgun hits the center of a barrel when striking of a shotgun shell in order to ignite the explosive in the shotgun shell. By tilting the sleeve in the shotgun barrel, the rim of the .22 caliber cartridge becomes positioned in the center line of a shotgun barrel. In accordance with the present invention, when the shotgun hammer strikes in the center of the shotgun barrel it will hit the rim of the .22 caliber cartridge igniting the explosive in it. The converter system for breach loading shotguns is constructed of four parts.

Figure 7:
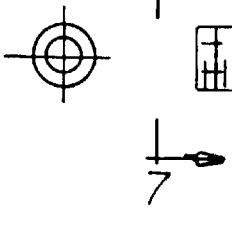
FIGS. 6 and 7 show a sleeve, side view and end view, for receiving a short sleeve nut.
Figure 6:
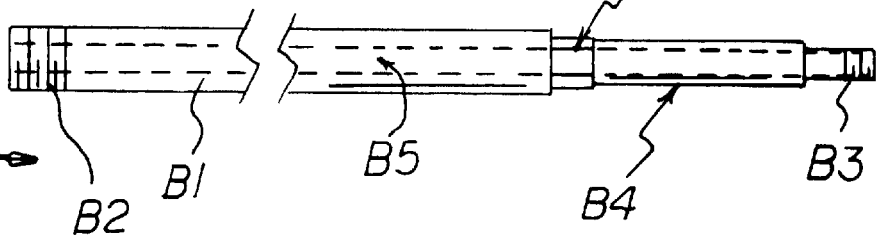
Figure 8:
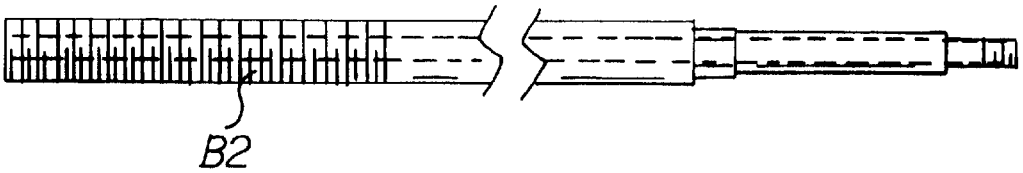
FIG. 8 is an alternate sleeve, side view, for the long sleeve nut of FIG. 1.

The first part is the sleeve nut A (FIGS. 1–5). The second part is the sleeve B (FIGS. 6–8). The third part is the dummy shell C (FIGS. 9–16). The fourth part D, E is the sight, (FIGS. 17–20) optionally for a single barrel shotgun or for a double barrel shotgun.

FIGS. 1–5 show the sleeve nut A-1 which is round steel with a hole drilled through for a ½-20 thread A-7. The outside of the sleeve nut has a knurled surface A-2 for good hand gripping. One end of the sleeve nut has a ball or angle shaped interior end A-3. This is to centralize the front of the sleeve in the shotgun barrel when the nut is formed on the front of the sleeve. The other, or exterior, end A-4 of the sleeve nut has a machined hexagon. See FIG. 3. This allows the sleeve nut to be grasped and tightened with a tool. Normally the sleeve nut is about 1 inch long, but if the sleeve nut is elongated sleeve nut A5 it is made 10 inches long. See FIG. 1. In that case, it is optional to use one length of a steel sleeve in a variety of lengths of shotgun barrels, as for example, 18 inch to 28 inch long barrels. Such feature is optional. The ½-20 threads A-8 in the elongated sleeve nut A-5 are preferably 10 inches long. One inch is sufficient at the ball shaped end. The elongated sleeve nut is made the same as the above sleeve nut except that it has an extension welded to it in the form of a tail A9 which is a smaller tube than the gun barrel's inside diameter permitting it to be inserted loosely therein. See FIGS. 1, 2, 3, and 4. Another way to use a tool to grasp and tighten the sleeve nut is to have a hexagon shaped interior surface A-6 inside of the sleeve nut about ⅜ inch deep. In this manner, an Allen wrench can be used to grasp and tighten the nut. See FIGS. 4 and 5.

Shown in FIGS. 6, 7 and 8 is the sleeve, Part B, which is a steel tube B-1 with a .22 caliber rifling going through from one end to the other end B-5. The sleeve is about ½ inch in diameter and 20 inches long. The exterior end has a ½-20 exterior thread B-2 about 1 inch long to threadedly receive the short sleeve nut of FIG. 2 or optionally of FIG. 4, 1. If the exterior thread is 10 inches long, then the long sleeve nut of FIG. 1 can be used. See FIG. 8. The interior end of the sleeve, has an intermediate step B-4 about 3 inches long and 7/16 in diameter. The intermediate step has machined on it a hexagon shape B-6 for a tool to grab the sleeve in the event that the dummy shell is exchanged. The other or interior end B-4 is a step which has an interior step with a ⅜-18 thread about ¾ inch long. This is for the dummy shell to be screwed on.

Part C is a dummy shotgun shell of 20-16-12 or 10 gauge is shown in FIGS. 12–16. It is made of a round steel having a rim C-1 at its interior end like a real shotgun shell. It has a hole C-2 going through having the front end of C-2 a ⅜-20 thread about ¾ inch deep C-20 and the other half, or inner end, of the hole C-2 is a chamber C-3 for a .22 caliber rim fired cartridge. The interior end of the chamber which is on the dummy cartridge rim is formed as a cavity about 0.50 inches deep and ⅝ inch in diameter C-4. This is a clearance for the rim of the .22 caliber rim fire cartridge. It is also the clearance for the user's fingernail in order to grab the cartridge when it is to be removed from the chamber C-3. The ⅜-20 thread C-20 and the .22 caliber chamber C-3 are in the same line, but both the thread from the hole C-2 and the chamber C-3 are 3/32 inch off of the centerline in relation with the centerline of the dummy shell. See FIG. 13. As described above, this is for the steel tube, or sleeve B-1 to be able to be tilted in order to bring the rim of the .22 cartridge in the centerline with the centerline of the shotgun barrel. This is where the firing pin hits when it is struck by the shotgun hammer. The ejection of the .22 cartridge is manual. The user is normally using his fingernail for ejection, but there is an easier way for cartridge ejection. An interior supplemental hole C-5, FIG. 14, can be drilled parallel with the ⅜-20 thread of the hole C20 and the .22 caliber chamber C-3. This supplemental hole is deep, almost as deep as the length of the dummy cartridge. See FIG. 14. In this hole goes a nail C-6 which has a round head C-8. The side of the nail has a flat portion C-7 where a flat headed radial screw goes C-11. This radial screw has a location in a radial hole C-12 on the dummy cartridge. This is to prevent the nail from coming out from its location when it is pushed by the spring C-9. By doing so, the head of the nail C-8 pushes the cartridge out from its location. The rim of the .22 cartridge C-10 overlaps the head C-8 of the nail C-6 by hooking in it so it can push out the cartridge when the gun is broken open.

The flat portion C-7 of the nail also regulates the length of the cartridge which will stick out from the chamber when the gun is open. With this ejection system, the user can grab the .22 cartridge with his fingers rather than his fingernails and then with the fingers. Since the .22 cartridge sticks out about ¼ inch from the barrel of the gun when the gun is broken open, the frame of the gun will push it all the way into the barrel when the gun is closed into a shooting position. The nail head C-8 has a cavity located in the dummy shell next to, and axially offset from, the .22 cartridge rim cavity C-4. See FIGS. 12–16. As described above, the dummy shell has the chamber for the .22 rim fire cartridge 3/32 inch off the center line in relation with the centerline of the dummy cartridge in order for the firing pin to hit the rim of the .22 caliber rim cartridge. This does not limit the conversion system to convert a center fire shotgun shell solely to a rim fire cartridge. The system can easily convert a center fire shotgun shell to a smaller caliber center fire cartridge by simply centering the dummy cartridge into the center rather than 3/32 inch off of the center line as required for the dummy cartridge in order to be centered for a rim fire cartridge.

Referring now to FIGS. 17–20, there are shown sights, Parts D and E, which may be of either of two types. The first type is a sight, Part D, for a single barrel shotgun. See FIG. 17. It is made of a spring ring D-1 about 7/8 inch in diameter having an open bottom D-2. The opening is about 1/4 inch. The top of the ring has a tail D-3 about 1 inch long and 5/16 inch wide having the end D-4 bent 90 degrees upward with a 1/16 inch radius notch D-5. Such notch may take any convenient shape such as a rectangular notch, a U-shaped notch, a V-shaped notch or the like. The ring is tempered and has a slight angle beginning from the front which get larger toward the tail. The angle is preferably the same angle as the angle on the shotgun barrel. The 1/4 inch opening D-2, the angle inside of the ring, and the tempering make the sight stay tight on the shotgun barrel. On the tail D-3 and in front of the 90 degree upward bend, there is drilled a hole D-6 for a 6-40 screw. In this hole goes a short 6-40 set screw D-7. By turning this screw, a user may adjust the sight up and down, directing the bullet up or down. By rotating the hole sight on the shotgun barrel left and right, a user may adjust the sight left and right, directing the bullet left or right which will adjust the bullet direction left or right. The direction of the bullet may also be adjusted by rotating the dummy cartridge in the gun barrel since it is off of the centerline in relation with the centerline of the shotgun barrel. See the drawings.

Once the rear sight for a single barrel shotgun is lined up on the front sight and the target, it can be also locked in if so desired, with a clamp of the hose clamp type. The clamp can be made of a steel bend 1/32 1/4" long so that it goes around across the shotgun barrel. Each end of the bend has a 90 degree bent up with a small hole in it about 1/8 inch in diameter. When the bend is bent across, once the rear sight which is pulled in place on the single barrel, the holes on the 90 degree bent up from the end of the bend will face each other so that the screw can be put into the holes and screwed into a nut. By tightening the screw into the nut, the clamp is pulled together locking the rear sight into position on the single barrel shotgun. This clamp is not necessary, but rather is optional. It is not pictured in the drawings. Alternately, the 90 degree bent up from the clamp can be directly incorporated on the sight steel ring D-1. Also, a hardened steel ring can be pulled over the sight steel ring D-1. With the slit or opening opposite to the slit or opening D-2 from D-1, the opening from the ring will be on the top of the barrel. This will serve the same function as the clamp.

The second type of sight, Part E, is shown in FIGS. 18, 19, 20, 21 and 22. This is a sight for a double barrel shotgun. It fits on the rib between the barrels. See FIG. 23. It is fastened on the rib A-1 with four small screws E-1. The sight is made of a piece of rectangular steel about 1/4 inch by 5/8 inch by 1-1/2 inch having on the end, at the top, a step E-2 with a 1/16 inch small radius groove E-3 or any other shaped groove, V, rectangular, etc. The bottom of the sight has a large rectangular groove reaching from one end to the other end forming two legs E-4. Each leg has three small holes. Two holes on each leg are threaded for the fastening screw E-1 which will fasten the sight on the rib, E1, FIG. 23-A, as can be seen in the drawings, are at the extremes of the legs. Between the screws E-1 is a through hole E-5 which is a smooth hole for a rivet E-6. Such a rivet is fastening to each leg E-4, a rectangular spring steel E-7 about 0.015 by 0.187 by 1.500 which has only one hole in the middle is for the rivet E-6 to fasten the spring steel E-7 to the legs E-4. When the four small screws E-1 are tightened, the spring steel E-7 is pushed against the shotgun barrel rib holding it in place. The rivets E-6 are needed to keep the spring steel E-7 together with the legs E-4. As can be seen on the Figures, the spring steel E-7 is fastened to the leg E-4 with the rivets E-6 in the middle. When pushed by the four screws E-1, this forms an arch reducing the space between the legs E-4. This is needed since the rib A-1, FIG. 23, in between the barrels are not a standard size width, the width of ribs of different guns varying slightly in size, occasionally even being tapered smaller at the beginning and wider at the end. With the four screws E-1 the variation of rib dimension can be overcome by turning the four screws which will push the spring steel E-7 against the rib side, keeping it on tight. This keeps the sight tight on the rib. The spring steel E-7 also is needed to prevent the four screws E-1 from leaving marks on the rib and it mainly prevents the sight from being rotated off of the rib when the four screws E-1 are rotated for tightening. The tightening will not work without the spring steel E-7. The above description is for a fixed sight. If needed, to adjust the sight to direct the bullet left or right, the groove E-3 can be adjusted by making the following: The groove E-3 has to be made wider E-8, FIG. 21, and the step E-2 has to be drilled from one extreme to the the extreme for a 6-40 thread, E-9 FIG. 21, which has to intersect the enlarged groove E-8. In the threaded hole E-9 will be turned in a threaded rod, E-10 FIG. 22, on which the thread in the middle area will be removed E-11 about 1/16 inch so it will look the same as the groove on E-2, FIG. 19, and preliminary it will be positioned in the middle of the enlarged groove E-8, FIG. 21, and then by turning E-10, FIG. 22, the groove E-11 will be moved left or right until the front sight of the gun, the target and E-11 is lined up. (See FIG. 22). Also at one extreme of the rod is a slit for a screwdriver E-12. By turning the threaded rod E-10, left or right in E-9, will move E-11 left or right directing the direction of the bullet. Once the direction is adjusted, the rod E-10 can be locked in place with a nut E-13 which is outside of E-2 or with set screw E-14 which will be inside of E-2. E-11 is actually the sight which will be lined up with the front sight and target. The existing fixed sight works fine. It does not really need adjustment for normal use. The gun shoots straight because of the dummy shell position in the shotgun barrel, To be more specific, on all double barrel shotguns, as has been described above, the rear sight, it is fastened onthe rib, FIG. 23, A-1, in between the barrels which would make the bullet go left or right depending on which barrel is fired and assuming that the centerline of the .22 cartridge in the sleeve is of, in relation with the horizontal centerline of the shotgun barrel, like the sleeve in the single shotgun barrel, but when the sleeve with the dummy shell and the .22 cartridge in it is rotated in a way that is of, on the vertical centerline in relation with the shotgun barrel, the bullet will go more to the centerline of the gun's barrel rib which is the bullet's straight line to the target. This happens since the back of the sleeve holding the cartridge in the dummy shell was brought closer to the centerline of the gun's rib. The front of the sleeve remains aligned with the center of the shotgun barrel, held in place by the ball ended barrel sleeve nut. To adjust the gun to shoot more up or down, it is adjusted by changing the height of the front sight on the gun barrel which is a very simple sight made of a rod threaded at the end which will screw in the threaded hole on the shotgun barrel, not pictured.

The conversion system is universal. The sleeve nut and the sleeve with the .22 caliber rifling fits all shotguns. To be fitted on a variety of shotguns gauged for 20-16-12-10 gauge shells. Only the dummy shotgun shel has to be changed for that particular shotgun which will be used. Also, the converter kit on a double barrel shotgun can be installed in one barrel only, leaving the other barrel for a shotgun shell. Or, if so desired by the user, it can be installed in both barrels allowing the shotgun to fire two .22 caliber cartridges. In the primary embodiment, the shotgun fires a .22 cartridge and a shotgun shell.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A removable system for converting a breach loading shot gun with center fire shotgun shell for use with .22 caliber rim fire or smaller center fire rifle cartridges comprising, in combination:

a cylindrical sleeve nut with an axial hole drilled through for a thread, the sleeve nut having a knurled exterior surface with one end of the sleeve nut having a ball, or optionally an angle shape, to centralize the front of the sleeve nut in a shotgun barrel and with the other end of the sleeve nut machined to a hexagon for allowing the sleeve nut to be tightened with a tool or optionally a hexagon formed inside of the nut whereby an Allen wrench can be used to tighten the sleeve nut;

a steel tube with a .22 caliber rifling with one end having a thread to threadedly receive the sleeve nut and with the steel tube having an intermediate step, the intermediate step having a hexagonally shaped surface machined at one end for a tool to grab the steel tube in the event that the dummy shell is exchanged, a second end of the steel tube having an interior step with a thread for a dummy shell to be screwed on;

a dummy shotgun shell having an exterior end and an interior end with a rim for receiving a rim of a .22 caliber rim fire cartridge, a hole through the interior end with a first half threaded halfway from the exterior end and a second half being a chamber for receiving a .22 caliber rim fired cartridge, the thread and the chamber lying in the same axial line but off of the centerline in relation with the centerline of dummy shell, and optionally, a supplemental hole drilled parallel with the thread and the chamber from the interior end of the dummy shell, almost as deep as the length of the dummy shell, a nail with a head and a flat portion positioned within the supplemental hole and a flat headed screw received in a radial hole at a location on the dummy shell to prevent the nail from coming out of the nail's location, with a spring to urge the nail outwardly so that the head of the nail pushes the cartridge out from the cartridge's location when the gun is broken open, the flat also regulating the length of the cartridge which will stick out from the chamber when the gun is open, the nail head having a cavity located in the dummy shell next to a .22 cartridge rim cavity, the dummy shell chamber being off the centerline in relation with the centerline of the dummy shell in order for a firing pin to hit the rim of the .22 caliber rim fire cartridge;

a sight for a single barrel shotgun fabricated of a spring ring having an open bottom and a tail at the top of the ring having an end bend of 90 degrees upward with a radius notch, the ring being tempered with a slight angle beginning from the front and enlarging toward the tail, a hole on the tail in front of the bend with a short set screw for adjusting the sight up and down, directing the bullet up or down, and by rotating the hole sight on the shotgun barrel left and right adjusting the sight left and right; and an optional second sight for a double barrel shotgun having a rib between the barrels, the second sight positionable on the rib with four small fastening screws, the second sight being fabricated of a piece of rectangular steel having a step on an end at the top and a small radius groove and a large groove at the bottom reaching from one end to the other end forming two legs with each leg having three small holes including two threaded holes for the fastening screws and a third hole between the screws with a rivet extending through the third hole to an associated sight leg, and a rectangular spring steel having only one hole in the middle for the rivet to fasten to the spring steel forming an arch reducing the space between the legs and barrel rib accommodating a variety of barrel rib dimensions and allowing slight adjustment to the sight left or right whereby the groove can be adjustable.

2. A removable system for converting a breach loading shot gun with center fire cartridges for use with .22 caliber rim fire rifle cartridges comprising:

a cylindrical sleeve nut with an axial hole drilled through with a thread at the nut's interior end and with a ball shape at the interior end to centralize the sleeve nut in a shotgun barrel;

a steel tube with a .22 caliber rifling with an exterior end having a thread to threadedly receive the sleeve nut and an intermediate step having a hexagonally shaped surface machined on the intermediate step and with an interior end having a step formed with a thread for a dummy shell to be screwed on; and a dummy shotgun shell having an exterior end and an interior end with a rim for receiving a rim of a .22 caliber rim fire cartridge, a hole through the interior end with a first half threaded halfway from the exterior end and a second half being a chamber for receiving a .22 caliber rim fired cartridge or smaller center fire cartridge, the thread and the chamber being in the same axial line but offset from the centerline of the dummy shell.

3. The system as set forth in claim 2 and further including:

a sight for a single barrel shotgun fabricated of a spring ring having an open bottom and a tail at the top of the ring having an end bend of 90 degrees upward with a radius notch, the ring being tempered with a slight angle beginning from the front and enlarging toward the tail, a hole on the tail in front of the bend with a short radial set screw for adjusting the sight up and down, directing the bullet up or down, and by rotating the hole sight on the shotgun barrel left and right adjusting the sight left and right.

4. The system as set forth in claim 2 and further including:

a second sight for a double barrel shotgun having a rib between the barrels, the sight positionable on the rib with four small fastening screws, the sight being fabricated of a piece of rectangular steel having a step on an end at the top and a small radius groove and a large groove at the bottom reaching from one end to the other end forming two legs with each leg having three small holes including two threaded holes for the fastening screws and a third hole between the screws with a rivet extending through the third hole to an associated sight leg, and a rectangular spring steel having only one hole in the middle for the rivet to fasten to the spring steel forming an arch reducing the space between the legs to accommodate variation of the gun's rib and also to slightly adjust the sight left or right whereby the groove can be adjustable.

* * * * *